United States Patent [19]

Vatsky

[11] Patent Number: 5,011,400

[45] Date of Patent: Apr. 30, 1991

[54] CONTROLLED FLOW SPLIT STEAM BURNER ASSEMBLY WITH SORBENT INJECTION

[75] Inventor: Joel Vatsky, Millburn, N.J.

[73] Assignee: Foster Wheeler Energy Corporation, Clinton, N.J.

[21] Appl. No.: 948,471

[22] Filed: Dec. 29, 1986

Related U.S. Application Data

[63] Continuation of Ser. No. 828,074, Feb. 3, 1986, abandoned, which is a continuation of Ser. No. 604,706, Apr. 27, 1984, abandoned.

[51] Int. Cl.[5] ..... F23J 7/00

[52] U.S. Cl. ..... 431/4; 431/188; 431/10; 110/264; 110/343; 239/416.5; 239/552; 423/244; 423/247

[58] Field of Search ..... 431/188, 284, 10, 190, 431/4; 110/263, 264, 343; 239/552, 416.5; 423/242, 244, 247

[56] References Cited

U.S. PATENT DOCUMENTS

| | | | |
|---|---|---|---|
| 3,746,498 | 7/1973 | Stengl | 431/4 |
| 4,235,585 | 11/1980 | Anderson | 431/4 X |
| 4,347,052 | 8/1982 | Reed et al. | 431/188 |
| 4,348,170 | 9/1982 | Vatsky et al. | 431/188 |
| 4,440,100 | 4/1984 | Michelfelder et al. | 431/4 X |
| 4,440,100 | 4/1984 | Michelfelder et al. | 431/4 X |
| 4,447,203 | 5/1984 | Hampton et al. | 431/4 X |
| 4,465,000 | 8/1984 | Shimoda | 110/343 |

*Primary Examiner*—Carl D. Price

*Attorney, Agent, or Firm*—Marvin A. Naigur

[57] ABSTRACT

A burner assembly in which an inlet is located at one end of an annular passage for receiving fuel, and an outlet is located at the other end of the passage for discharging the fuel. A register assembly is provided which includes an enclosure for receiving air and a divider for directing the air from the enclosure towards the outlet in two parallel paths extending around the burner. Registers are disposed in each of the paths for regulating the quantity of air flowing through the paths and an injector is provided in the outer path for injecting sulfur adsorbent into the secondary air stream.

21 Claims, 2 Drawing Sheets

CONTROLLED FLOW SPLIT STEAM BURNER ASSEMBLY WITH SORBENT INJECTION

This application is a continuation of application Ser. No. 828,074, filed Feb. 3, 1986 which, in turn, is a continuation of application Ser. No. 604,706, filed April 27, 1984, both abandoned.

BACKGROUND OF THE INVENTION

This invention relates generally to a burner assembly and more particularly to an improved burner assembly which operates in a manner to reduce the formation of nitrogen oxides and sulfur dioxides as a result of fuel combustion.

In a typical arrangement for burning coal in a vapor generator, several burners are disposed in communication with the interior of the furnace and operate to burn a mixture of air and pulverized coal. The burners used in these arrangements are generally of the type in which a fuel-air mixture is continuously injected through a nozzle so as to form a single, relatively large, flame.

In the burning of coal in this manner, unacceptable levels of sulfur dioxide are produced which must be reduced in order to meet government standards of air quality. Also, when the flame temperature at the burner exceeds 2800° F., the amount of fixed nitrogen removed from the combustion supporting air rises exponentially with increases in the temperature. This condition leads to the production of high levels of nitrogen oxides in the final combustion products, which also causes severe air pollution problems.

Control of sulfur dioxide emissions is usually achieved by external means such as wet or dry flue gas desulfurization. In-situ control (i.e., within the furnace) has been under investigation for many years and utilizes either a pre-mixing of limestone (or other sorbent) with coal, or an injection of pulverized sorbent external to the burner throat through separate ports or small injection nozzles. However, both of these techniques have distinct drawbacks. The injection of the sorbent with the coal usually yields low sulfur dioxide capture ratios due to deadburning of the sorbent and can lead to increased slagging. The external injection of the sorbent requires numerous wall penetrations, tube bends and expensive piping and burner staging controls for the ports.

Also, sorbent injection between or above the burners can limit sulfur capture due to several effects:

Inadequate mixing between the products of combustion and the sorbent particles;

Insufficient residence time in the boiler's radiant zone; and

Increased slagging and sorbent deposition to the boiler's sidewalls when sorbent is injected to the lower burner levels of a multiple level boiler. This injection location also reduces sulfur capture since sorbent particles can be re-entrained in the high temperature portion of the flame.

These deficiencies can be corrected by injecting sorbent in conjunction with an internally staged low $N0_x$ burner. This type of burner reduces $N0_x$ by at least 50%, as compared to turbulent burners, without simultaneous use of external combustion air staging systems such as overfire or tertiary air ports. However, when overfire air ports are used, $N0_x$ reductions as great as 75% can be obtained. An internally-staged low $N0_x$ burner can be defined as one which yields fuel-rich and fuel-lean zones within a flame envelope similar to that of a turbulent burner. This is in contrast to delayed mixing burners which produce very long narrow flames which gradually combust the fuel over a substantially greater distance than is characteristic of either turbulent or internally staged burners.

Other attempts, including two-stage combustion, flue gas recirculation and the introduction of an oxygen-deficient fuel-air mixture suppress the flame temperature and reduce the quantity of available oxygen during the combustion process and thus reduce the formation of nitrogen oxides. However, although these attempts singularly may produce some beneficial results they have not resulted in a reduction of nitrogen oxides to minimum levels. Also, these attempts have often resulted in added expense in terms of increased construction costs and have led to other related problems such as the production of soot and the like, nor do they lend themselves to sulfur control via sorbent injection.

SUMMARY OF THE INVENTION

It is therefore an object of the present invention to provide a burner assembly which operates in a manner to considerably reduce the production of sulfur dioxides and nitrogen oxides in the combustion of fuel without any significant increase in cost or other related problems.

It is a further object of the present invention to provide a controlled flow/split-flame low $N0_x$ burner of an internally staged design which, when combined with sorbent injection, effectively reduces sulfur emissions.

It is a more specific object of the present invention to provide a burner assembly in which the surface area of the flame per unit volume is increased which results in a greater flame radiation, a lower flame temperature, and a shorter residence time of the gas component within the flame at maximum temperature, thereby reducing the formation of thermal nitrogen oxides by fixation of atmospheric nitrogen.

It is a still further object of the present invention to provide a burner assembly of the above type in which the stoichiometric combustion of the fuel is regulated to reduce the quantity of available oxygen during the combustion process and achieve an attendant reduction in the formation of nitrogen oxides from the fuel-bound nitrogen.

Another more specific object of the present invention is to provide a burner assembly of the above type in which secondary air is directed toward the burner outlet in two parallel paths with register means being disposed in each path for individually controlling the flow of air through each path.

Still another more specific object of the present invention is to provide a burner assembly of the above type in which pre-pulverized sorbent is injected through the outer parallel path of the above-mentioned secondary air stream to reduce the formation of sulfur dioxide without the problems set forth above.

Toward the fulfillment of these and other objects, the burner assembly of the present invention includes an annular passage having an inlet located at one end thereof for receiving fuel, and an outlet located at the other end of the passage for discharging the fuel. Air is directed towards the outlet in two parallel paths extending around the burner, and a plurality of register vanes are disposed in each of the paths for regulating the quantity of air flowing through the paths. A series of injectors are disposed in the outer parallel path for injecting sorbent for the sulfur generated as a result of the coal combustion.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENTS

Figure 1:
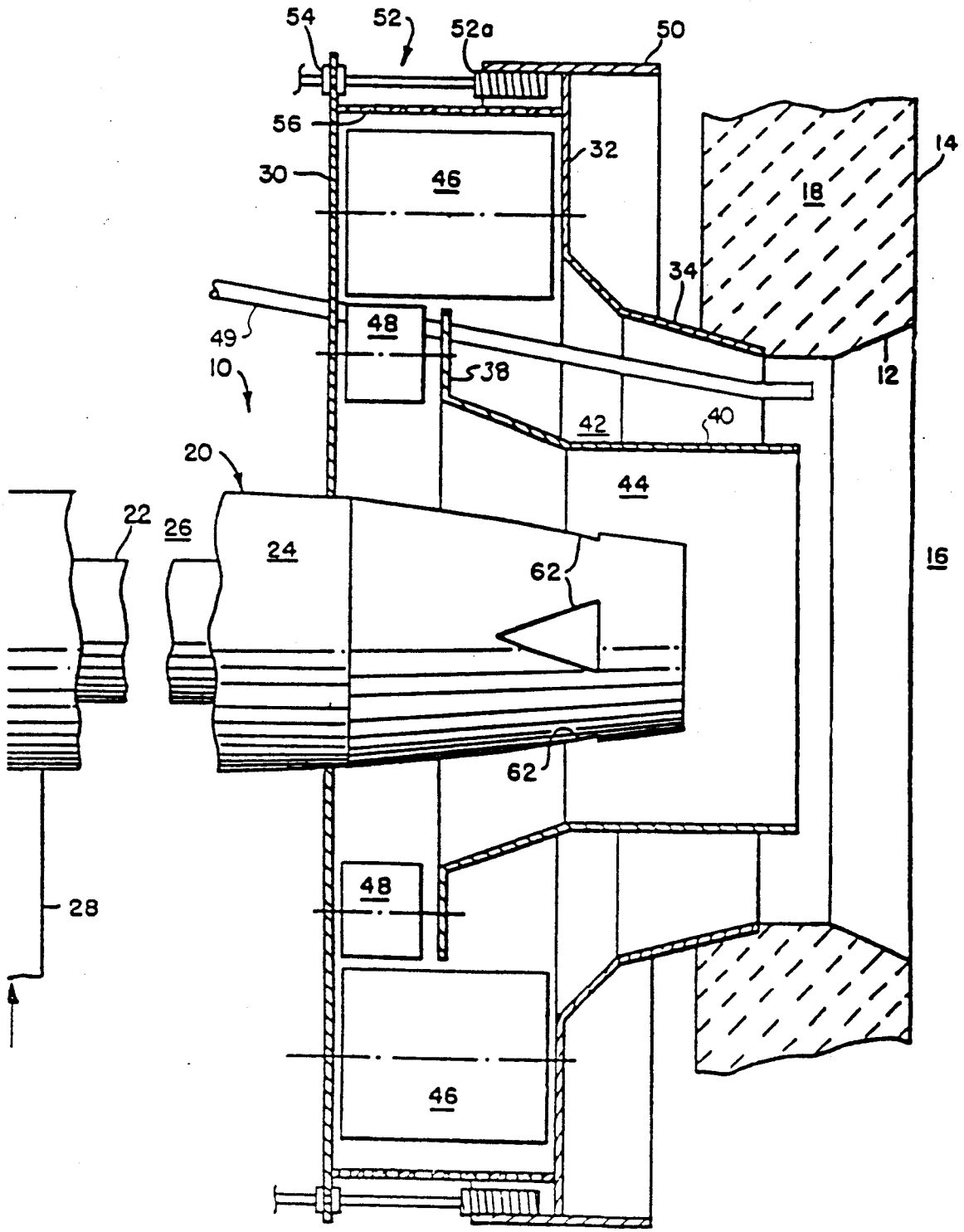
FIG. 1 is a sectional view depicting the burner assembly of the present invention.

Referring specifically to FIG. 1 of the drawings the reference numeral 10 refers in general to a burner assembly which is disposed in axial alignment with a through opening 12 formed in a front wall 14 of a conventional furnace. It is understood that the furnace includes a back wall and side walls of an appropriate configuration to define a combustion chamber 16 immediately adjacent the opening 12. Also similar openings are provided in the furnace front wall 14 for accommodating additional burner assemblies identical to the burner assembly 10. The inner surface of the wall 14 as well as the other walls of the furnace are lined within an appropriate thermal insulation material 18 and, while not specifically shown, it is understood that the combustion chamber 16 can also be lined with boiler tubes through which a heat exchange fluid, such as water, is circulated in a conventional manner for the purposes of producing steam.

It is also understood that a vertical wall is disposed in a spaced parallel relationship with the furnace wall 14 in a direction opposite that of the furnace opening 12 along with correspondingly spaced top, bottom and side walls to form a plenum chamber, or wind box, for receiving combustion supporting air, commonly referred to as "secondary air", in a conventional manner.

The burner assembly 10 includes a nozzle 20 having an inner tubular member 22 and an outer tubular member 24. The outer tubular member 24 extends over the inner tubular member 22 in a coaxial, spaced relationship thereto to define an annular passage 26 which extends towards the furnace opening 12.

A tangentially disposed inlet 28 communicates with the outer tubular member 24 for introducing a stream of fuel into the annular passage 26 as will be explained in further detail later.

A pair of spaced annular plates 30 and 32 extend around the burner 20, with the inner edge of the plate 30 terminating on the outer tubular member 24. A liner member 34 extends from the inner edge of the plate 32 and in a general longitudinal direction relative to the burner 20 and terminates adjacent the insulation material 18 just inside the wall 14. An additional annular plate 38 extends around the burner 20 in a spaced, parallel relation with the plate 30. An air divider sleeve 40 extends from the inner surface of the plate 38 and between the liner 34 and the nozzle 20 in a substantially parallel relation to the burner 20 and the liner 34 to define two air flow passages 42 and 44.

A plurality of outer register vanes 46 are pivotally mounted between the plates 30 and 32 to control the swirl of secondary air from the wind box to the air flow passages 42 and 44. In a similar manner a plurality of inner register vanes 48 are pivotally mounted between the plates 30 and 38 to further regulate the swirl of the secondary air passing through the annular passage 44. It is understood that although only two register vanes 46 and 48 are shown in FIG. 1, several more vanes extend in a circumferentially spaced relation to the vanes shown. Also, the pivotal mounting of the register vanes 46 and 48 may be done in any conventional manner, such as by mounting the vanes on shafts (shown schematically in FIG. 1) and journaling the shafts in proper bearings formed in the plates 30, 32 and 38. Also, the position of the vanes 46 and 48 may be adjustable by means of cranks or the like. Since these types of components are conventional they are not shown in the drawings nor will be described in any further detail.

A plurality of sorbent injectors 49 are provided, each of which extends through the plates 30 and 38, between two vanes 48 and into the air flow passage 42. The inlet end portion (not shown) of each injector 49 is connected to a source of sorbent such as limestone, Ca(0H)2, or the like, and the discharge end is located at the opening 12 of the front wall 14. Although not clear from the drawing, it is understood that more than two injectors 49 can be provided in a equilangularly spaced relation around the nozzle 20, and that the velocity of injection and injection angle can be controlled at each injector in a conventional manner.

Figure 2:
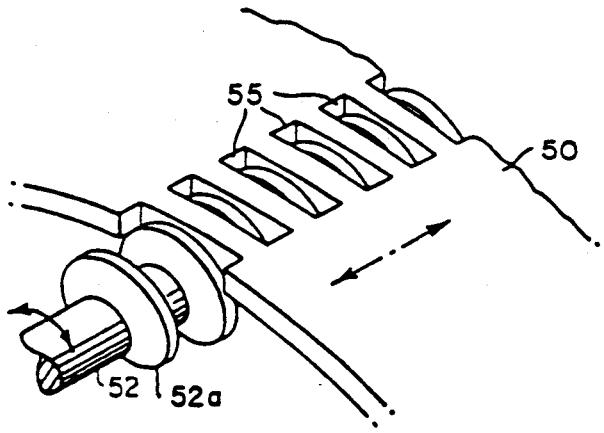
FIG. 2 is a partial perspective view of a component of the burner assembly of FIG. 1.

The quantity of air flow from the wind box into the register vanes 46 is controlled by movement of a sleeve 50 which is slidably disposed on the outer periphery of the plate 32 and is movable parallel to the longitudinal axis of the burner nozzle 20. An elongated worm gear 52 is provided for moving the sleeve 50 and is better shown in FIG. 2. The worm gear 52 has one end portion suitably connected to an appropriate drive means (not shown) for rotating the worm gear and the other end provided with threads **52*a*. The worm gear 52 extends through a bushing 54 (FIG. 1) which is attached to the plate 30 to provide rotatable support. The threads 52*a* of the worm gear 52 mesh with appropriate apertures 55 formed in the sleeve 50 so that, upon rotation of the worm gear, the sleeve moves longitudinally with respect to the longitudinal axis of the burner 20 and across the air inlet defined by the plates 30 and 32. In this manner, the quantity of combustion supporting air from the wind box passing through the air flow passages 42 and 44 can be controlled by axial displacement of the sleeve 50. A perforated air hood 56 extends between the plates 30 and 32 immediately downstream of the sleeve 50 to permit independent measurement of the air flow to the burner 20**.

Figure 4:
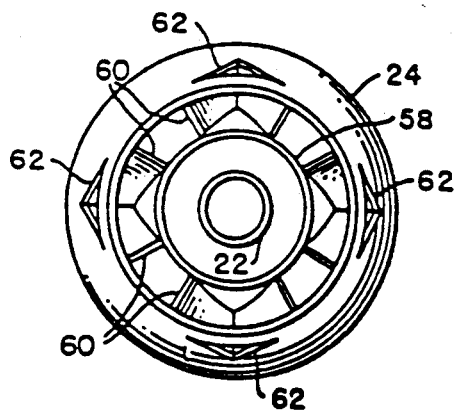
FIG. 4 is an end view of the burner portion of FIG. 3.
Figure 3:
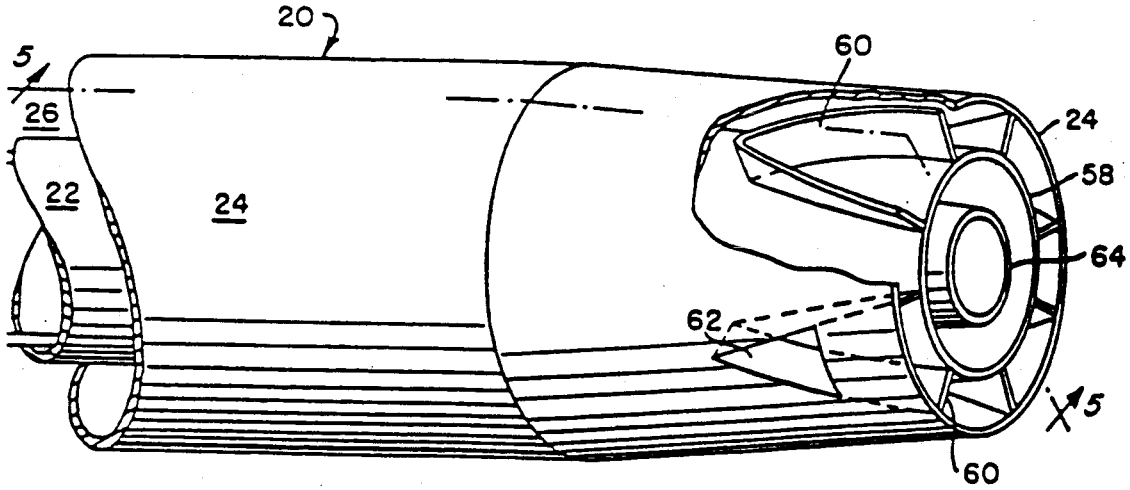
FIG. 3 is an enlarged elevational view, partially cutaway, of the burner portion of the assembly of the present invention.
Figure 5:
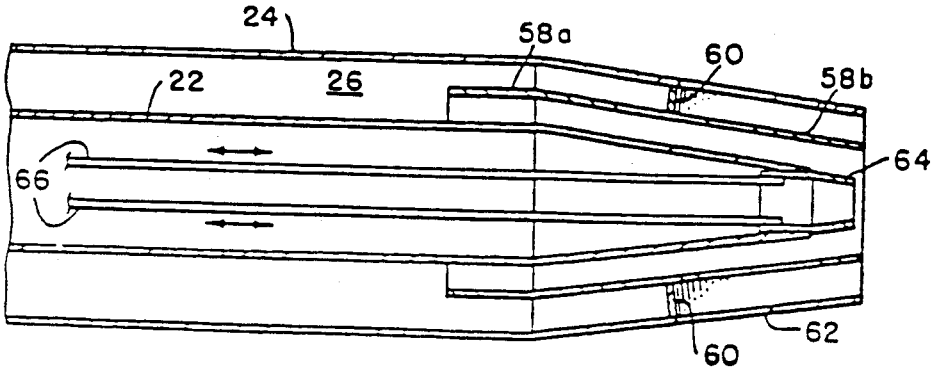
FIG. 5 is a cross-sectional view taken along the line 5—5 of FIG. 3.

As shown in FIGS. 3-5, which depict the details of the nozzle 20, the end portion of the outer tubular member 24 and the corresponding end portion of the inner tubular member 22 are tapered slightly radially inwardly toward the furnace opening 12. A divider cone 58 extends between the inner tubular member 22 and the outer tubular member 24. The divider cone 58 had a straight portion **58*a* (FIG. 5) which extends between the straight portions of inner tubular member 22 and the outer tubular member 24, and a tapered portion 58***b* which extends between the tapered portions of the tubular members for the entire lengths thereof. The function of the divider cone 58 will be described in greater detail later.

A plurality of V-shaped splitters 60 are circumferentially spaced in the annular space between the outer tubular member 24 and the divider cone 58 in the outlet end portion of the nozzle 20. As shown in FIGS. 3 and 4, four such splitters 60 are spaced at 90° intervals and extend from the outlet to a point approximately midway between the tapered portions of the tubular members 22 and 24. Each splitter 60 is formed by two plate members welded together at their ends to form a V-shape. The plate members are also welded along their respective longitudinal edges to the outer tubular member 24 and the divider cone 58 to support the splitters and the divider cone in the nozzle 20. The apex of each splitter 60 is disposed upstream of the nozzle outlet so that the fuel-air stream flowing in the annular space between the divider cone 58 and the outer tubular member 24 will be directed into the adjacent spaces defined between the splitters to facilitate the splitting of the fuel stream into four separate streams.

Four pie-shaped openings 62 are formed through the outer tubular member 24 and respectively extend immediately over the splitters 60. These openings are for the purpose of admitting secondary air from the inner air flow passage 44 (FIG. 1) into the annular space defined between the divider cone 58 and the outer tubular member 24 for reasons that will be explained in detail later.

As shown in FIG. 5, a tip 64 is formed on the end of the tapered portion of the inner tubular member 22 and is movable relative to the latter member by means of a plurality of rods 66 extending within the tubular member and affixed to the inner wall of the tip. The other ends of the rods 66 can be connected to any type of actuator device (not shown) such as a hydraulic cylinder of the like to effect longitudinal movement of the rods and therefore the tip 64 in a conventional manner.

It can be appreciated from a view of FIG. 5 that the longitudinal movement of the tip 64 varies the effective outlet opening defined between the tip and the divider cone 58 so that the amount of fuel-air flowing through this opening can be regulated. Since the divider cone 58 divides the fuel-air mixture flowing through the annular passage 26 into two radially spaced parallel streams extending to either side of the divider cone 58, it can be appreciated that movement of the tip 64 regulates the relative flow of the two streams while varying their velocity.

It is understood that appropriate ignitors can be provided adjacent the outlet of the nozzle 20 for igniting the coal as it discharges from the nozzle. Since these ignitors are of a conventional design they have not been shown in the drawings in the interest of clarity.

In operation of the burner assembly of the present invention, the movable sleeve 50 associated with each burner is adjusted during initial start up to accurately balance the air to each burner. After the initial balancing, no further movement of the sleeves 50 are needed since normal control of the secondary air flow to the burners is accomplished by operation of the outer burner vanes 46. However, if desired, flow control can be accomplished by the sleeve.

Fuel, preferably in the form of pulverized coal suspended or entrained within a source of primary air, is introduced into the tangential inlet 28 where it swirls through the annular chamber 26. Since the pulverized coal introduced into the inlet 28 is heavier than the air, the pulverized coal will tend to move radially outwardly towards the inner wall of the outer tubular member 24 under the centrifugal forces thus produced. As a result, a great majority of the coal along with a relatively small portion of air enters the outer annular passage defined between the outer tubular member 24 and the divider cone 58 (FIG. 5) where it encounters the apexes of the splitters 60. The stream is thus split into four equally spaced streams which discharge from the nozzle outlet and, upon ignition, form four separate flame patterns. Secondary air from the inner air passage 44 (FIG. 1) passes through the inlets 62 formed in the outer tubular member 24 and enters the annular passage between the latter member and the divider cone 58 to supply secondary air to the streams of coal and air discharging from the outlet.

The remaining portion of the air-coal mixture passing through the annular passage 26 enters the annular passage defined between the divider cone 58 and the inner tubular member 22. The mixture entering this annular passage is mostly air due to the movement of the coal radially outwardly, as described above. The position of the movable tip 64 can be adjusted to precisely control the relative amount, and therefore velocity, of the air and coal discharging from the nozzle 20 from the annular passages between the outer tubular member 24 and the divider cone 58 and between the divider cone and the inner tubular member 22.

Secondary air from the wind box is admitted through the perforated hood 56 and into the inlet between the plates 30 and 32. The axial and radial velocities of the air are controlled by the register vanes 46 and 48 as it passes through the air flow passages 42 and 44 and into the furnace opening 12 for mixing with the coal from the nozzle 20. The igniters are then shut off after steady state combustion has been achieved.

Sorbent is injected, by the injectors 49, into the secondary air stream flowing through the flow passage 42 at the opening 12 to capture the sulfur dioxide produced as a result of combustion of the coal.

As a result of the foregoing, several advantages result from the burner assembly of the present invention. For example, since the pressure drop across the perforated air hoods 56 associated with the burner assemblies can be equalized by balancing the secondary air flow to each burner by initially adjusting the sleeves 50, a substantially uniform flue gas distribution can be obtained across the furnace. This also permits a common wind box to be used and enables the unit to operate at lower excess air with significant reductions in both nitrogen oxides and carbon monoxides. Also, the provision of separate register vanes 46 and 48 for the outer and inner air flow passages 42 and 44 enables secondary air distribution and flame shape to be independently controlled resulting in a significant reduction of nitrogen oxides, and a more gradual mixing of the primary air coal stream with the secondary air since both streams enter the furnace on parallel paths with controlling mixing.

Further, the provision of multiple flame patterns results in a greater flame radiation, a lower average flame temperature and a shorter residence time of the gas components within the flame at a maximum temperature, all of which, as stated above, contribute to reduce the formation of nitric oxides.

Still further, the provision of the tangential inlet 26 provides excellent distribution of the fuel around the annular space 26 in the nozzle 20, resulting in more complete combustion and reduction of carbon loss and making it possible to use individual burners with capacities significantly higher than otherwise could be used. Provision of the inlet openings 62 in the outer tubular member permits the introduction of a portion of the secondary air to be entrained with the fuel-air stream passing through the annular passage between the outer tubular member 24 and the divider cone, since the majority of this stream will be primarily pulverized coal. As a result, a substantially uniform air-coal ratio across the entire cross-section of the air-coal stream is achieved. Also, the provision of the movable tip 64 to regulate the flow of the coal-air mixture passing through the inner annular passage defined between the divider cone 58 and the inner tubular member 22 enable the air flow on both sides of the divider cone to be regulated thereby optimizing the primary air velocity with respect to the secondary air velocity.

Also, by injecting the sorbent into the outer secondary air annulus the particles will by-pass the hottest part of the flame so that a minimum of deadburning of the sorbent will occur. Also, since the sorbent particles will be rapidly entrained in the swirling secondary air from this outer secondary annulus they will be intimately mixed with the products of combustion as soon after passing the peak flame temperature zone as is feasible. This increases the efficiency of the sulfur capture and results in capture that is equal to or better than capture methods external to the burner throat.

It is understood that several variations and additions may be made to the foregoing within the scope of the invention. For example, since the arrangement of the present invention permits the admission of air at less than stoichiometric for further reductions in $N0_x$ emissions, overfire air ports, or the like can be provided as needed to supply air to complete the combustion. Also, the distribution of the sorbent injectors 49 around the periphery of the burner can be varied to obtain optimum sulfur capture. Additionally, the burner levels which receive sorbent injectors are dependent on the number of burner levels, slagging characteristics of the coal ash and the gas temperature at the exit to the furnace's radiant zone. Boilers with three or more burner levels need only have the top two levels contain sorbent injectors. This is sufficient to provide an effective calcination zone for calcium-based sorbents along with a long residence time for sulfation reactions to occur prior to the furnace exit.

As will be apparent to those skilled in the art, various changes and modifications may be made to the embodiments of the present invention without departure from the spirit and scope of the present invention as defined in the appended claims and the legal equivalent.

What is claimed is:

1. A burner assembly for introducing fuel and air into an inlet passage formed through a furnace wall, said assembly comprising nozzle means having an outlet for discharging a mixture of air and fuel into said inlet passage, means for discharging air into said inlet passage in an inner and outer radially spaced path, each of which are radially spaced from said nozzle, and means for discharging sorbent into said inlet passage downstream of said nozzle outlet and downstream of the discharge area of said air from said radially outer path, said sorbent mixing with said air during their passage through said inlet passage before they enter the interior of said furnace.

2. The burner assembly of claim 1 further comprising a plurality of vanes respectively disposed in each of said paths for regulating the spin and/or quantity of air flowing through said paths.

3. The burner assembly of claim 1 further comprising means disposed within said nozzle for splitting up said mixture as it discharges from said nozzle means so that, upon ignition of said fuel, a plurality of flame patterns are formed.

4. The burner assembly of claim 1 wherein said nozzle comprises an inner tubular member and an outer tubular member extending around said inner tubular member in a coaxial relation thereto to define an annular discharge passage.

5. The burner assembly of claim 4 further comprising an opening formed in a portion of said outer tubular member for admitting additional air from the radially inward path to the radially outer stream of mixture.

6. The burner assembly of claim 1 further comprising means for dividing said mixture into two radially spaced parallel streams as it discharges from said nozzle means.

7. The burner assembly of claim 6 further comprising means for regulating the flow rate of the radially inner stream of mixture.

8. The burner assembly of claim 1 further comprising means for regulating the quantity of air introduced into said inlet passage from said paths.

9. The burner assembly of claim 8 wherein said regulating means comprises an enclosure surrounding said burner and having an inlet for said air, a sleeve movable across said latter inlet to vary the size of said latter inlet.

10. The burner assembly of claim 9 further comprising a perforated hood extending across said air inlet and cooperating with said movable sleeve to vary the size of said latter inlet and the quantity of air entering said enclosure.

11. The burner assembly of claim 1 in which said inlet passage includes a necked down portion and wherein said sorbent is discharged into said inlet passage at said necked down portion.

12. The burner assembly of claim 1 in which said sorbent discharge means discharges said sorbent independently of the discharge of said mixture from said nozzle.

13. A method of burning fuel comprising the steps of discharging a mixture of air and fuel into an area of an inlet passage formed through a furnace wall, discharging air into said inlet passage in an inner and outer radially spaced path, each of which are radially spaced from said discharge area of said nozzle, and discharging sorbent into said inlet passage downstream of the discharge area of said mixture and downstream of the discharge of said air from said radially outer path, said sorbent mixing with said air during their passage through said inlet passage before they enter the interior of said furnace.

14. The method of claim 13 further comprising the step of regulating the spin and/or quantity of air flowing through said paths.

15. The method of claim 13 further comprising the step of splitting up said mixture as it is discharged into said area so that, upon ignition of said fuel, a plurality of flame patterns are formed.

16. The method mixture of claim 10 further comprising the step of directing said mixture in a tangential direction relative to an annular passage formed in a nozzle before said step of discharging.

17. The method of claim 16 further comprising the step of dividing said mixture into two radially spaced parallel streams as it discharges into said inlet passage.

18. The method of claim 17 further comprising the step of regulating the flow rate of the radially inner stream of mixture.

19. The method of claim 17 further comprising the step of passing air from said radially inward path to the radially outer stream of mixture.

20. The method of claim 13 further comprising the step of regulating the quantity of air introduced into said inlet passage.

21. The method of claim 13 wherein said step of discharging said sorbent is performed independently of said step of discharging said mixture of air and fuel.

* * * * *